US010049540B2

(12) United States Patent
Yin

(10) Patent No.: US 10,049,540 B2
(45) Date of Patent: Aug. 14, 2018

(54) SAFE GUIDE DEVICE

(71) Applicant: Shenzhen Zhuiguang Electronic Technology Co.,Ltd, Shenzhen (CN)

(72) Inventor: Zhengkai Yin, Shenzhen (CN)

( * ) Notice: Subject to any disclaimer, the term of this patent is extended or adjusted under 35 U.S.C. 154(b) by 0 days.

(21) Appl. No.: 15/334,787

(22) Filed: Oct. 26, 2016

(65) Prior Publication Data

US 2017/0046930 A1 Feb. 16, 2017

Related U.S. Application Data

(63) Continuation of application No. PCT/CN2014/095061, filed on Dec. 26, 2014.

(30) Foreign Application Priority Data

May 16, 2014 (CN) ..... 2014 1 0208736

(51) Int. Cl.
*G08B 5/00* (2006.01)
*G08B 7/06* (2006.01)
*G08B 5/36* (2006.01)

(52) U.S. Cl.
CPC ..... *G08B 7/066* (2013.01); *G08B 5/36* (2013.01); *G08B 7/062* (2013.01)

(58) Field of Classification Search
CPC . G08B 7/066; G08B 5/36; G08B 5/38; G08B 7/06; G08B 7/062; A42B 1/242;
(Continued)

(56) References Cited

U.S. PATENT DOCUMENTS 5,485,355 A * 1/1996 Voskoboinik ..... H05B 33/00 313/358
6,472,994 B1 * 10/2002 Tator ..... F21S 9/022 340/332

(Continued)

*Primary Examiner* — Anh V La
(74) *Attorney, Agent, or Firm* — Wayne & Ken, LLC; Tony Hom

(57) ABSTRACT

A safe guide device, comprising light-emitting lines and a multi-channel alternating current driver (9) driving the light-emitting lines to operate; more than three light-emitting lines are arranged from front to back or arranged in parallel from left to right to form an arrow shape; the light-emitting lines comprise a first light-emitting line (3), a second light-emitting line (4), a third light-emitting line (5), a fourth light-emitting line (6), a fifth light-emitting line (7) and a sixth light-emitting line (8); the first light-emitting line (3), the second light-emitting line (4) and the third light-emitting line (5) are right hand twisted, or sequentially right hand wound around a first core shaft or a first core wire to form a first sequentially segmented light-emitting cable (1); the fourth light-emitting line (6), the fifth light-emitting line (7) and the sixth light-emitting line (8) are left hand twisted, or sequentially left hand wound around a second core shaft or a second core wire to form a second sequentially segmented light-emitting cable (2); the first sequentially segmented light-emitting cable (1) and the second sequentially segmented light-emitting cable (2) are arranged in parallel from left to right; and the first light-emitting line (3) and the fourth light-emitting line (6) form an arrow shape. The safe guide device has the characteristics of simple and reasonable structure, flexible operation, clear guidance, and wide application range.

4 Claims, 6 Drawing Sheets

(58) Field of Classification Search
CPC .. A42B 1/244; B60Q 3/78; B60Q 1/26; F21S 4/10; F21S 4/20; F21S 2/00; A43B 3/001; A43B 3/0005; A43B 1/0036; G09F 13/22; A41D 27/085; A45C 15/06; F21Y 2105/00; F21W 2131/109
USPC ..... 340/815.4, 815.42, 815.45; 362/84, 103, 362/104; 40/544, 542
See application file for complete search history.

(56) References Cited

U.S. PATENT DOCUMENTS

| | | | | |
|---|---|---|---|---|
| 6,590,502 | B1 * | 7/2003 | Pederson | B60Q 1/2611 340/815.4 |
| 7,395,629 | B1 * | 7/2008 | Thomas | A01K 77/00 43/11 |
| 7,800,511 | B1 * | 9/2010 | Hutchison | G08B 7/066 340/3.1 |
| 2003/0095052 | A1 * | 5/2003 | Dechape | G08G 1/095 340/908 |
| 2003/0196360 | A1 * | 10/2003 | Colip | G09F 13/22 40/610 |
| 2003/0231485 | A1 * | 12/2003 | Chien | A41D 27/085 362/84 |
| 2008/0115957 | A1 * | 5/2008 | Duffy | H01B 7/32 174/112 |
| 2014/0368357 | A1 * | 12/2014 | Carter | B60Q 1/52 340/907 |
| 2015/0194904 | A1 * | 7/2015 | Harbourt | H02M 7/06 318/503 |

* cited by examiner

SAFE GUIDE DEVICE

CROSS-REFERENCE TO RELATED APPLICATIONS

This application is a continuation of International Patent Application No. PCT/CN2014/095061 with a filing date of Dec. 26, 2014, designating the United States, now pending, and further claims priority to Chinese Patent Application No. 201410208736.8 with a filing date of May 16, 2014. The content of the aforementioned applications, including any intervening amendments thereto, are incorporated herein by reference.

TECHNICAL FIELD

The present invention relates to a safe guide device.

BACKGROUND OF THE PRESENT INVENTION

Generally, all halls, buildings and various public facilities are provided with safe exits which are basically provided with fire safety indicating lights, such as automatic start emergency lights when the electricity is turned off, while these fire safety indicating lights are a kind of dot-shaped light-emitting safety guide facility; in the passage of large buildings, especially in mine tunnels and large complex places, dot-shaped light-emitting safety guide facility this to continuously guide and it's easy to cause chaos and further losses.

Chinese patent document No. CN 1916679B disclosed a sequentially segmented light-emitting field optical cable line on Jan. 19, 2011, which comprises light-emitting core wires, a guidance line and a transparent external layer. There are at least two groups of light-emitting core wires sequentially twisted into a cable line or a center line is being added therein. There are at least two groups of light-emitting core wires sequentially wound spirally around the center line, mixed layer of light-emitting powder and binder and metal transparent electrode layer are coated only on the outer surface of the light-emitting core wires; Inside the light-emitting core wires, the dielectric coated on the metal baseline is the compound of titanium dioxide and polyurethane.

SUMMARY OF PRESENT INVENTION

The present invention aims to provide a safe guide device with simple and reasonable structure, flexible operation, clear guidance, and wide application range to overcome the disadvantages of the prior art.

The safe guide device designed for this purpose comprises a plurality of light-emitting lines and a multi-channel alternating current driver driving the light-emitting lines to operate. The structure characterized in that more than three light-emitting lines are arranged in front or rear or arranged in parallel by left and right side to form an arrow shape.

Further, the plurality of light-emitting lines comprise a first light-emitting line, a second light-emitting line, a third light-emitting line, a fourth light-emitting line, a fifth light-emitting line and a sixth light-emitting line.

The first light-emitting line, the second light-emitting line and the third light-emitting line are right hand twisted, or sequentially right hand wound around a first core shaft or a first core wire to form a first sequentially segmented light-emitting cable.

The fourth light-emitting line, the fifth light-emitting line and the sixth light-emitting line are left hand twisted, or sequentially left hand wound around a second core shaft or a second core wire to form a second sequentially segmented light-emitting cable.

The first sequentially segmented light-emitting cable and the second sequentially segmented light-emitting cable are arranged in parallel by left and right side.

The first light-emitting line and the fourth light-emitting line form an arrow shape, the second light-emitting line and the fifth light-emitting line form an arrow shape and the third light-emitting line and the sixth light-emitting line form an arrow shape.

Further, a multi-channel alternating current driver is provided with a switching power supply circuit, a power storage circuit and storage battery, a sensing circuit and sensor, a high frequency inverter circuit, a starting control chip and starting control circuit, a three-channel unit AC (Alternating Current) output controller. The switching power supply circuit is separately connected with the storage circuit and storage battery and the sensing circuit and sensor and provides power supply for the multi-channel alternating current driver. The high frequency inverter circuit and the staffing control chip and the starting control circuit are mutually connected with the three-channel unit AC output controller. A first group of AC output circuit, a second group of AC output circuit and a third group of AC output circuit are arranged on the three-channel unit AC output controller.

Further, the first group of AC output circuit is separately connected with the first light-emitting line and the fourth light-emitting line. The second group of AC output circuit is separately connected with the second light-emitting line and the fifth light-emitting line. The third group of AC output circuit is separately connected with the third light-emitting line and the sixth light-emitting line.

Further, the outside of the first sequentially segmented light-emitting cable and the second sequentially segmented light-emitting cable are wrapped with transparent, temperature and burning resistant plastic layer or protective layer made of glassfiber material.

Further, the light-emitting lines comprise a seventh light-emitting line, an eighth light-emitting line and a ninth light-emitting line. More than three arrow slots are sequentially arranged on a second mounting panel, and the seventh light-emitting line is embedded in the first arrow slot, the eighth light-emitting line is embedded the second arrow slot, the ninth light-emitting line is embedded in the third arrow slot.

Further, six arrow slots are sequentially arranged on the second mounting panel, and the seventh light-emitting line embedded in the first arrow slot is embedded in the fourth arrow slot after being turned back. The eighth light-emitting line embedded in the second arrow slot is embedded in the fifth arrow slot after being turned back. The ninth light-emitting line embedded in the third arrow slot is embedded in the sixth arrow slot after being turned back.

Further, the multi-channel alternating current driver is provided with a switching power supply circuit, a power storage circuit and storage battery, a sensing circuit and sensor, a high frequency inverter circuit, a starting control chip and starting control circuit, a three-channel unit AC output controller. The switching power supply circuit is separately connected with the storage circuit and storage battery and the sensor circuit and sensor and provides power supply for the multi-channel alternating current driver. The high frequency inverter circuit and the starting control chip and starting control circuit are mutually connected with the three-channel unit AC output controller. A first group of AC output circuit, a second group of AC output circuit and a third group of AC output circuit are arranged on the three-channel unit AC output controller.

Further, the first group of AC output circuit is connected with the seventh light-emitting line, the second group of AC output circuit is connected with the eighth light-emitting line, and the third group of AC output circuit is connected with the ninth light-emitting line.

Further, the light-emitting lines comprise a tenth light-emitting line, an eleventh light-emitting line and a twelfth light-emitting line, more than three arrow slots are sequentially arranged on the third mounting panel.

The tenth light-emitting line is embedded in the first arrow slot, the eleventh light-emitting line is embedded in the second arrow slot, the twelfth light-emitting line is embedded in the third arrow slot.

The multi-channel alternating current driver is provided with a switching power supply circuit, a storage circuit and storage battery, a sensor circuit and sensor, a high frequency inverter circuit, a starting control chip and starting control circuit and a three-channel unit AC output controller, wherein the switching power supply circuit is separately connected with the storage circuit and storage battery and the sensor circuit and sensor and provides power to the multi-channel alternating current driver; while the high frequency inverter circuit, the start control chip and start control circuit are mutually connected with the three-channel unit AC output controller.

The first group of AC output circuit, the second group of AC output circuit and the third group of AC output circuit are arranged on the three-channel unit AC output controller.

The first group of AC output circuit comprises a neutral line and a first AC output line, the second group of AC output circuit comprises a neutral line and a second AC output line, the third group of AC output circuit comprises a neutral line and a third AC output line.

Both ends of the tenth light-emitting line are separately connected with the neutral line and the first AC output line. Both ends of the eleventh light-emitting line are separately connected with the neutral line and the second AC output line. Both ends of the twelfth light-emitting line are separately connected with the neutral line and the third AC output line.

In the present invention, more than three light-emitting lines are arranged in front or rear side or arranged in parallel by left and right side to form an arrow shape. The arrow-shaped light-emitting lines are linearly arranged so that it can provide uninterrupted guidance along the safe route.

The light-emitting lines of the present invention are EL light-emitting round lines. Same effect described above could also be achieved if the EL light-emitting round lines are replaced with EL light-emitting flat lines or EL light-emitting plate or strip.

The light-emitting lines in his present invention have a good guidance function for correct route when start working, the light-emitting lines are arrow-shaped and sequentially glow one by one as flowing arrows, to guide people advance according to the direction of the arrows or escape according to right direction in emergency.

The first sequentially segmented light-emitting cable and the second sequentially segmented light-emitting cable in this present invention are respectively right hand twisted structure and left hand twisted structure, which are spirally twisted made up of more than three light-emitting lines capable of emitting light according to a certain direction or wound around a core shaft or a core wire. The axis line of each light-emitting line of the first sequentially segmented light-emitting cable and the second sequentially segmented light-emitting cable is an oblique angle, and they are combined into a group of light-emitting arrows keeping moving forward as running water when arranged in parallel and in working. Driven by the multi-channel alternating current driver, each light-emitting line of the first sequentially segmented light-emitting cable and the second sequentially segmented light-emitting cable sequentially glows and extinguishes. People can only see one side of the first sequentially segmented light-emitting cable and the second sequentially segmented light-emitting cable and the sight maintains persistence of vision, so that what can be seen is some light-emitting arrows sequentially move as running water. When this present invention starts, the light-emitting arrows begin to move clearly and smoothly as running water and can change rate according to the change of the risk of the surrounding environment.

The multi-channel alternating current driver in this present invention could gradually accelerate the moving frequency of the light-emitting arrow from 0.5 times per second to more than 10 times per second according to the environment change and emit high frequency flash light to warn danger and guide people to quickly escape from dangerous zones.

The present invention has the characteristics of simple and reasonable structure, flexible operation, clear guidance and wide application range, and especially suitable for the passages of large complex buildings, mine tunnels and underground car parks.

Figure 1:
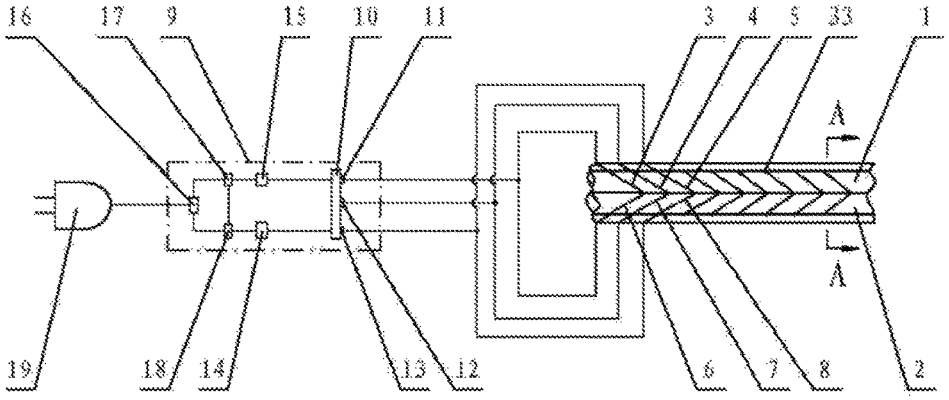
FIG. 1 is a schematic diagram of the first embodiment of the present invention.

In the drawings, (1) is the first sequentially segmented light-emitting cable, (2) is the second sequentially segmented light-emitting cable, (3) is the first light-emitting line, (4) is the second light-emitting line, (5) is the third light-emitting line, (6) is the fourth light-emitting line, (7) is the fifth light-emitting line, (8) is the sixth light-emitting line, (9) is the multi-channel alternating current driver, (10) is the three-channel unit AC output controller, (11) is the first group of AC output circuit, (12) is the second group of AC output circuit, (13) is the third group of AC output circuit, (14) is the start control chip and start control circuit, (15) is the high frequency inverter circuit, (16) is the switching power supply circuit, (17) is the power storage circuit and storage battery, (18) is the sensing circuit and sensors (19) is the power plug, (33) is the burning resistant plastic layer, (34) is the first mounting panel, (35) is the mounting hole, (40) is the second mounting panel, (41) is the seventh light-emitting line, (42) is the eighth light-emitting line, (43) is the ninth light-emitting line, (44) is the positioning pillar, (45) is the arrow slot, (50) is the third mounting panel, (51) is the tenth light-emitting line, (52) is the eleventh light-emitting line, (53) is the twelfth light-emitting line, (54) is the thirteenth light-emitting line, (55) is the fourteenth light-emitting line, (56) is the fifteenth light-emitting line, (61) is the first AC output line, (62) is the second AC output line, and (63) is the third AC output line.

DETAILED DESCRIPTION OF PREFERRED EMBODIMENTS

The present invention will be further described as below with reference to the accompanying drawings and embodiments.

Embodiment 1

Figure 2:
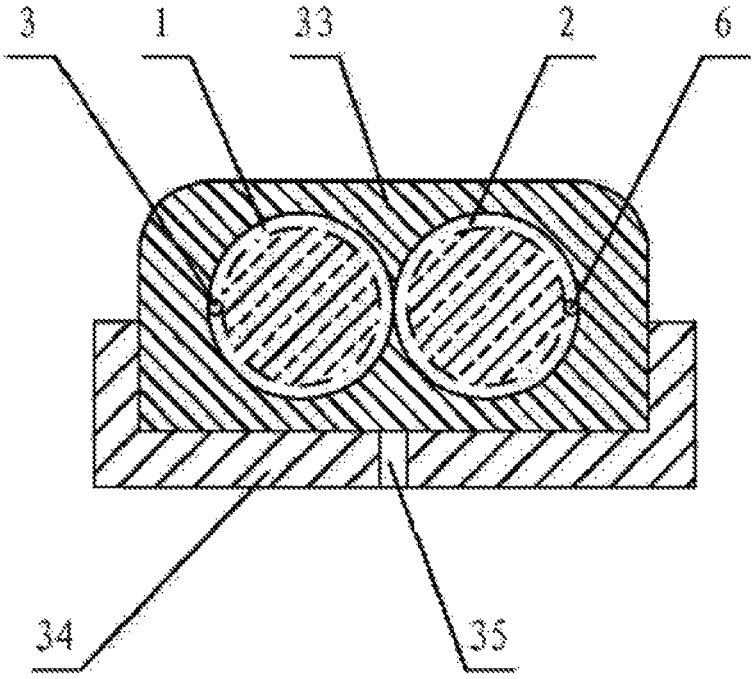
FIG. 2 is a partial sectioning enlarged view of A-A in FIG. 1.

Referring to FIG. 1 and FIG. 2 the safe guide device comprises a plurality of light-emitting lines and a multi-channel alternating current driver (9) driving the light-emitting lines to operate. More than three light-emitting lines are arranged in front or rear side or arranged in parallel by left and right side to form an arrow shape.

The plurality of light-emitting lines comprise a first light-emitting line (3), a second light-emitting line (4), a third light-emitting line (5), a fourth light-emitting line (6), a fifth light-emitting line (7) and a sixth light-emitting line (8). The first light-emitting line (3), the second light-emitting line (4) and the third light-emitting line (5) are right hand twisted, or sequentially right hand wound around a first core shaft or a first core wire to form a first sequentially segmented light-emitting cable (1). The fourth light-emitting line (6), the fifth light-emitting line (7) and the sixth light-emitting line (8) are left hand twisted, or sequentially left hand wound around a second core shaft or a second core wire to form a second sequentially segmented light-emitting cable (2). The first sequentially segmented light-emitting cable (1) and the second sequentially segmented light-emitting cable (2) are arranged in parallel by left and right side. The first light-emitting line (3) and the fourth light-emitting line (6) form an arrow shape. The second light-emitting line (4) and the fifth light-emitting line (7) form an arrow shape. The third light-emitting line (5) and the sixth light-emitting line (8) form an arrow shape.

The multi-channel alternating current driver (9) is provided with a switching power supply circuit (16), a power storage circuit and storage battery (17), a sensing circuit and sensor (18), a high frequency inverter circuit (15), a starting control chip and starting control circuit (14), a three-channel unit AC output controller (10), the switching power supply circuit (16) is separately connected with the storage circuit and storage battery (17) and the sensing circuit and sensor (18) and provides power supply to the multi-channel alternating current driver. The high frequency inverter circuit (15), the starting control chip and starting control circuit (14) are mutually connected with the three-channel unit AC output controller (10), a first group of AC output circuit (11), a second group of AC output circuit (12) and a third group of AC output circuit (13) are arranged on the three-channel unit AC output controller (10).

The first group of AC output circuit (11) is separately connected with the first light-emitting line (3) and the fourth light-emitting line (6), the second group of AC output circuit (12) is separately connected with the second light-emitting line (4) and the fifth light-emitting line (7), the third group of AC output circuit (13) is separately connected with the third light-emitting line (5) and the sixth light-emitting line (8).

The first sequentially segmented light-emitting cable (1) and the second sequentially segmented light-emitting cable (2) are wrapped with transparent temperature and burning resistant plastic layer or glass or glassfiber protective layer.

When the multi-channel alternating current driver (9) starts working, the starting control chip controls the three-channel unit AC output controller (10) to sequentially electrify and break based on setting procedures, so that the first light-emitting line (3) and the fourth light-emitting line (6) are connected through the first group of AC output circuit (11), the first light-emitting line (3) and the fourth light-emitting line (6) form the first group of light-emitting lines; the second light-emitting line (4) and the fifth light-emitting line (7) are connected through the second group of AC output circuit (12), and the second light-emitting line (4) and the fifth light-emitting line (7) form the second group of light-emitting lines; the third light-emitting line (5) and the sixth light-emitting line (8) are connected through the third group of AC output circuit (13), and the third light-emitting line (5) and the sixth light-emitting line (8) form the third group of light-emitting lines.

Three groups of light-emitting line are sequentially electrified to glow and disconnected to extinguish, frequency of which ranges from 0.03 s to 1.5 s; the speed of glowing and extinguishing are faster than the reaction speed of human eyes. By taking full advantage of the characteristic of maintaining persistence of vision of human eyes, people can see the light-emitting arrows commonly formed by the first light-emitting line (3) of the first sequentially segmented light-emitting cable (1) and the fourth light-emitting line (6) of the second sequentially segmented light-emitting cable (2). The light-emitting arrows flow as running water toward the right to the position of the light-emitting arrows commonly formed by the second light-emitting line (4) and the fifth light-emitting line (7). And then, the light-emitting arrows flow as running water toward the right to the position of the light-emitting arrows commonly formed by the third light-emitting line (5) and the sixth light-emitting line (8). The dynamic effect of these light-emitting lines is obvious and visual so that it can complete safe guide function in any complex environment.

In this present embodiment, since the first sequentially segmented light-emitting cable (1) and the second sequentially segmented light-emitting cable (2) are wrapped with transparent temperature-resistant and burning resistant plastic layer (33) or glass or fiberglass protective layer, so that the first sequentially segmented light-emitting cable (1), the second sequentially segmented light-emitting cable (2) and the burning resistant plastic layer (33) could be commonly assembled on the first mounting panel (34). In addition, the first mounting panel (34) could be fixed on the place to perform safe guidance via the mounting hole (35) set on the first mounting panel (34).

The cross section structure of the first sequentially segmented light-emitting cable (1) and the second sequentially segmented light-emitting cable (2) could be a circle as shown in FIG. 2.

Embodiment 2

Figure 3:
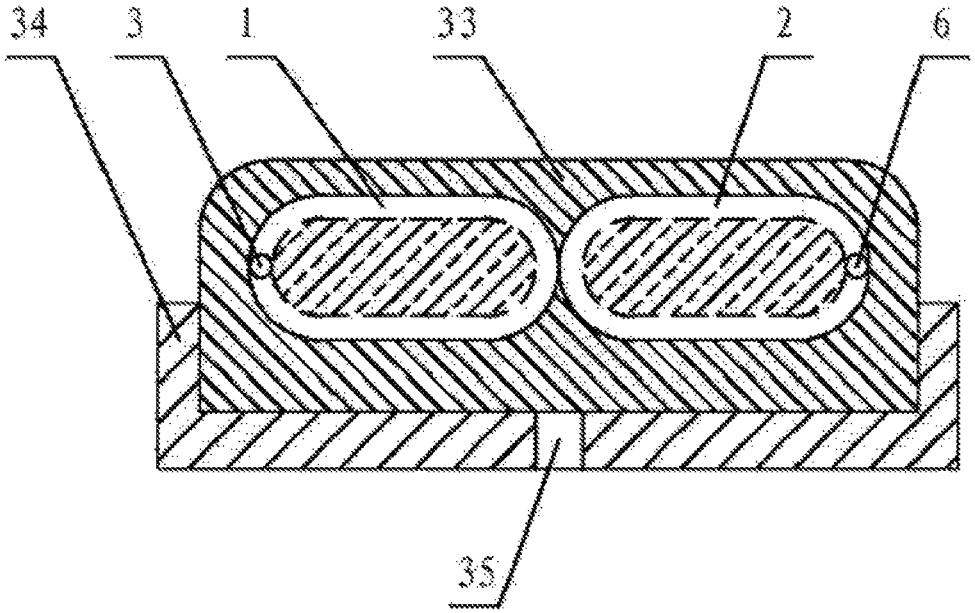
FIG. 3 is a partial sectioning enlarged view of the second embodiment of the present invention.

Referring to FIG. 3, in this embodiment, the cross section structure of the first sequentially segmented light-emitting cable (1) and the second sequentially segmented light-emitting cable (2) could be an ellipse or oval shape as shown in FIG. 3.

The rest part not being described has already been described in the first embodiment and do not repeat herein.

Embodiment 3

Figure 4:
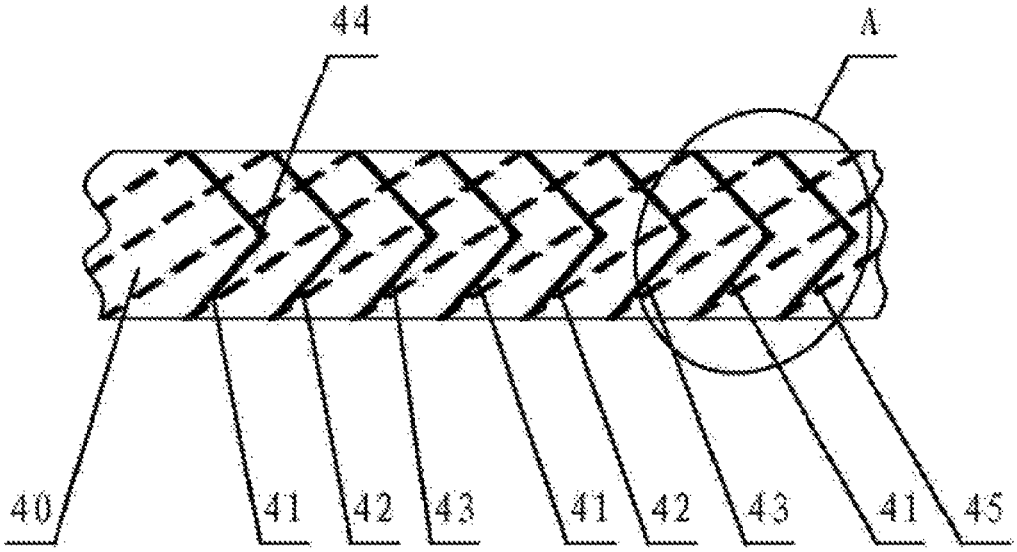
FIG. 4 is a schematic diagram of the third embodiment of the present invention.
Figure 5:
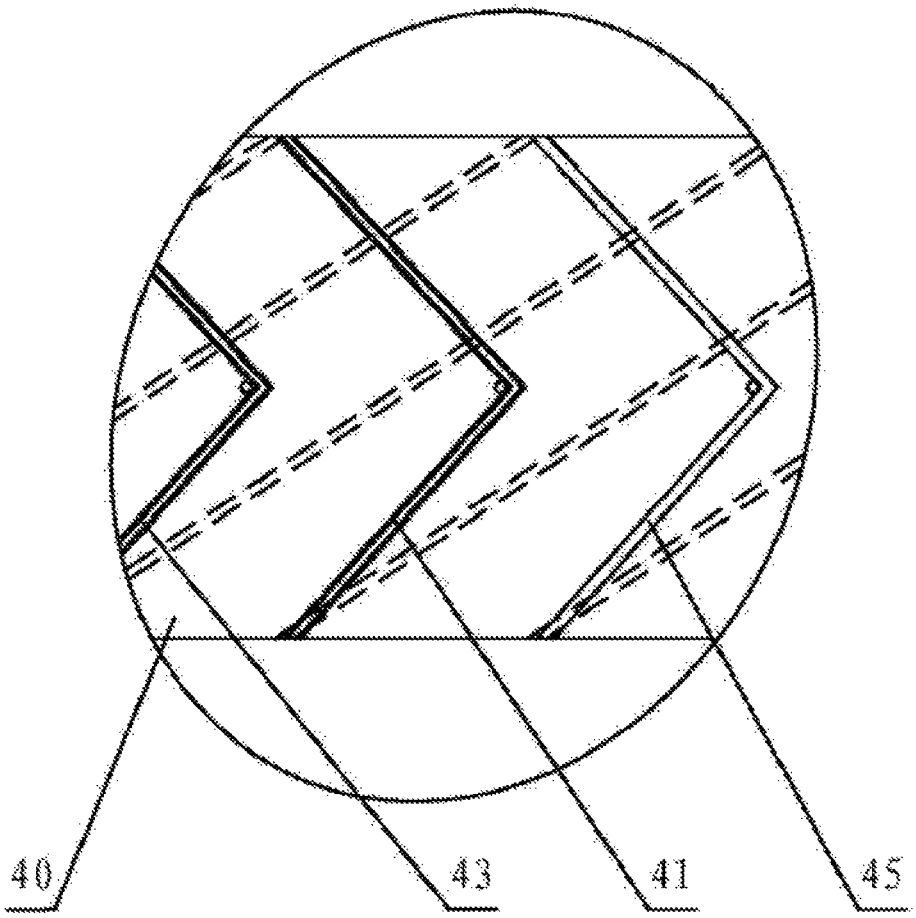
FIG. 5 is a partially enlarged view of FIG. 4.

Referring to FIG. 4 and FIG. 5, in this embodiment, the light-emitting lines comprise a seventh light-emitting line (41), an eighth light-emitting line (42), and a ninth light-emitting line (43). More than three arrow slots (45) are sequentially arranged on the second mounting panel (40), the seventh light-emitting line (41) is embedded in the first arrow slot (45), the eighth light-emitting line (42) is embedded in the second arrow slot (45), and the ninth light-emitting line (43) is embedded in the third arrow slot (45).

Six arrow slots (45) are sequentially arranged on the second mounting panel (40), the seventh light-emitting line (41) embedded in the first arrow slot is embedded in the fourth arrow slot (45) after being turned back, the eighth light-emitting line (42) embedded in the second arrow slot (45) is embedded in the fifth arrow slot (45) after being turned back, the ninth light-emitting line (43) embedded in the third arrow slot (45) is embedded in the sixth arrow slot (45) after being turned back.

The multi-channel alternating current driver (9) is provided with a switching power supply circuit (16), a power storage circuit and storage battery (17), a sensing circuit and sensor (18), a high frequency inverter circuit (15), a starting control chip and starting control circuit (14), and a three-channel unit AC output controller (10), the switching power supply circuit (16) is separately connected with the storage circuit and storage battery (17) and the sensor circuit and sensor (18) and provides power to the multi-channel alternating current driver; while the high frequency inverter circuit (15), the starting control chip and starting control circuit (14) are mutually connected with the three-channel unit AC output controller (10), a first group of AC output circuit (11), a second group of AC output circuit (12) and a third group of AC output circuit (13) are arranged on the three-channel unit AC output controller (10). The first group of AC output circuit (11) is connected with the seventh ht-emitting line (41), the second group of AC output circuit (12) is connected with the eighth light-emitting line (42), and the third group of AC output circuit (13) is connected with the ninth light-emitting line (43).

The second mounting panel (40) could be made of opaque material.

Referring to FIG. 4 and FIG. 5, in this embodiment, the seventh light-emitting line (41) is successive, and the seventh light-emitting line (41) embedded in the first arrow slot (45) is embedded in the fourth arrow slot (45) again after being turned back. Similarly, the eighth light-emitting line and the ninth light-emitting line are also embedded in the same way.

To be steadily and securely embedded a positioning pillar (44) could be set on the turning point of the arrow slot (45).

The rest part not being described has already been described in the second embodiment, and will not be repeated here.

Embodiment 4

Figure 6:
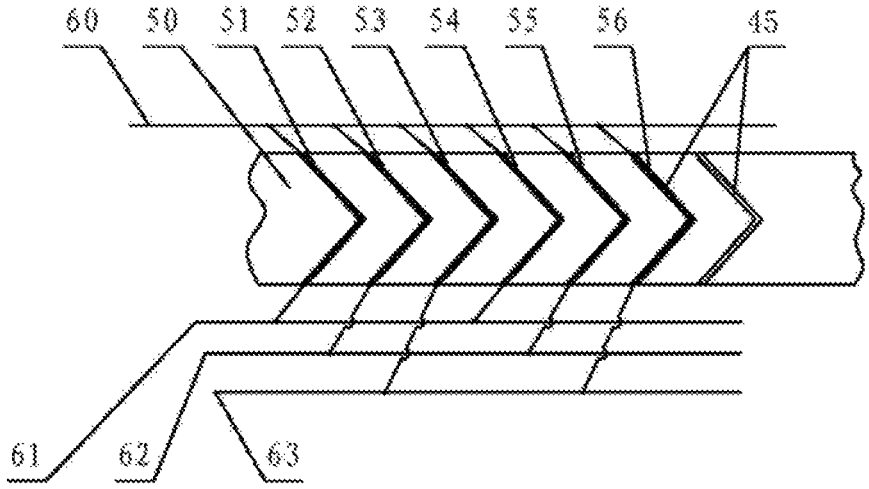
FIG. 6 is a schematic diagram of the fourth embodiment of the present invention.

Referring to FIG. 6, in this embodiment, the light-emitting lines comprise a tenth light-emitting line (51), an eleventh light-emitting line (52), and a twelfth light-emitting line (53). More than three arrow slots (45) are sequentially arranged on the third mounting panel (50), the tenth light-emitting line (51) is embedded in the first arrow slot (45), the eleventh light-emitting line (52) is embedded the second arrow slot (45) and the twelfth light-emitting line (53) is embedded in the third arrow slot (45).

The multi-channel alternating current driver (9) is provided with switching power supply circuit (16), a power storage circuit and storage battery (17), a sensing circuit and sensor (18), a high frequency inverter circuit (15), a starting control chip and starting control circuit (14), a three-channel unit AC output controller (10), the switching power supply circuit (16) is separately connected with the power storage circuit and storage battery (17) and the sensing circuit and sensor (18) and provides power supply for the multi-channel alternating current driver; The high frequency inverter circuit (15), the starting control chip and starting control circuit (14) are mutually connected with the three-channel unit AC output controller (10), the first group of AC output circuit (11), the second group of AC output circuit (12) and the third group of AC output circuit (13) are arranged on the three-channel unit AC output controller (10).

The first group of AC output circuit (11) comprises a neutral line (60) and a first AC output line (61), the second group of AC output circuit (12) comprises a neutral line (60) and a second AC output line (62), the third group of AC output circuit (13) comprises a neutral line (60) and a third AC output line (63).

Both ends of the tenth light-emitting line (51) are separately connected with the neutral line (60) and the first AC output line (61), both ends of the eleventh light-emitting line (52) are separately connected with the neutral line (60) and the second AC output line (63); both ends of the twelfth light-emitting line (53) are separately connected with the neutral line (60) and the third AC output line (63).

In this embodiment, the light-emitting lines also comprise a thirteenth light-emitting line (54), a fourteenth light-emitting line (55), and a fifteenth light-emitting line (56), as the tenth light-emitting line (51), the eleventh light-emitting line (52) and the twelfth light-emitting line (53), the thirteenth light-emitting line (54), the fourteenth light-emitting line (55) and the fifteenth light-emitting line (56) are also embedded in the arrow slot (45) and separately connected with the first group of AC output circuit (11), the second group of AC output circuit (12) and the third group of AC output circuit (13).

The third mounting panel (50) could be made of opaque material.

In this embodiment, the tenth light-emitting line (51), the eleventh light-emitting line (52), the twelfth light-emitting line (53), the thirteenth light-emitting line (54), the fourteenth light-emitting line (55), and the fifteenth light-emitting line (56) are separately independent. During installation, both electrodes of the tenth light-emitting line (51), the eleventh light-emitting line (52), the twelfth light-emitting line (63), thirteenth light-emitting line (54), the fourteenth light-emitting line (55) and the fifteenth light-emitting line (56) are sequentially connected with the three-channel unit AC output controller (10) on the multi-channel alternating current driver (9); the neutral line (60) is the common neutral line, while the first AC output line (61), the second AC output line (62), and the third AC output line (63) are all live lines; the tenth light-emitting line (51) and the thirteenth light-emitting line (54) are connected with the first AC output line (61); the eleventh light-emitting line (52) and the fourteenth light-emitting line (55) are connected with the second AC output line (62), the twelfth light-emitting line (53) and the fifteenth light-emitting are connected with the third AC output line (63);

Among all the above-mentioned embodiments, same effect can be achieved by replacing the EL light-emitting lines with EL light-emitting flat lines or EL light-emitting plate or strip.

The rest part not being described has already been described in the second embodiment and will not be repeated here.

What is claimed is:

1. A safe guide device, comprising: a plurality of light-emitting lines and a multi-channel alternating current driver driving the plurality of light-emitting lines to operate, wherein more than three light-emitting lines are arranged in parallel by left and right side to form an arrow shape;

the plurality of light-emitting lines comprise a first light-emitting line, a second light-emitting line, a third light-emitting line, a fourth light-emitting line, a fifth light-emitting line and a sixth light-emitting line;

wherein the first light-emitting line, the second light-emitting line and the third light-emitting line are right hand twisted, or sequentially right hand wound around a first core shaft or a first core wire to form a first sequentially segmented light-emitting cable;

and the fourth light-emitting line, the fifth light-emitting line and the sixth light-emitting line are left hand twisted, or sequentially left hand wound around a second core shaft or a second core wire to form a second sequentially segmented light-emitting cable;

the first sequentially segmented light-emitting cable and the second sequentially segmented light-emitting cable are arranged at left and right side and in parallel with each other;

the first light-emitting line and the fourth light-emitting line are arranged to form an arrow shape, the second light-emitting line and the fifth light-emitting line are arranged to form an arrow shape, and the third light-emitting line and the sixth light-emitting line are arranged to form an arrow shape;

the multi-channel alternating current driver is provided with a switching power supply circuit, a power storage circuit and storage battery, a sensing circuit and sensor, a high frequency inverter circuit, a starting control chip and starting control circuit, and a three-channel unit Alternating Current (AC) output controller; wherein the switching power supply circuit is separately connected with the power storage circuit and storage battery and the sensing circuit and sensor: the switching power supply circuit provides power supply to the multi-channel alternating current driver; the high frequency inverter circuit and the starting control chip and starting control circuit are mutually connected with the three-channel unit AC output controller; wherein a first group of AC output circuit, a second group of AC output circuit and a third group of AC output circuit are arranged on the three-channel unit AC output controller;

the first group of AC output circuit is separately connected with the first light-emitting line and the fourth light-emitting line, the second group of AC output circuit is separately connected with the second light-emitting line and the fifth light-emitting line, the third group of AC output circuit is separately connected with the third light-emitting line and the sixth light-emitting line; and wherein the outside of the first sequentially segmented light-emitting cable and the second sequentially segmented light-emitting cable are wrapped with transparent, temperature and burning resistant plastic layer or protective layer made of glass fiber material.

2. The safe guide device according to claim 1, characterized in that the light-emitting line is an EL light-emitting flat line, an EL light-emitting plate or an EL light-emitting strip.

3. A safe guide device, comprising: a plurality of light-emitting lines and a multi-channel alternating current driver driving the plurality of light-emitting lines to operate, characterized in that at least three light-emitting lines are arranged in front or rear side to form an arrow shape, characterized in that the light-emitting lines comprise a seventh light-emitting line, an eighth light-emitting line and a ninth light-emitting line: six arrow slots are sequentially arranged on a second mounting panel, wherein the seventh light-emitting line is embedded in the first arrow slot, the eighth light-emitting line is embedded the second arrow slot, and the ninth light-emitting line is embedded in the third arrow slot; wherein the seventh light-emitting line embedded in the first arrow slot is embedded in the fourth arrow slot after being turned back, the eighth light-emitting line embedded in the second arrow slot is embedded in the fifth arrow slot after being turned back and the ninth light-emitting line embedded in the third arrow slot is embedded in the sixth arrow slot after being turned back.

4. The safe guide device according to claim 3, wherein the multi-channel alternating current driver is provided with a switching power supply circuit, a power storage circuit and storage battery, a sensing circuit and sensor, a high frequency inverter circuit, a starting control chip and starting control circuit, and a three-channel unit AC output controller, wherein the switching power supply circuit is separately connected with the power storage circuit and storage battery and the sensor circuit and sensor and is configured to provide power supply for the multi-channel alternating current driver; the high frequency inverter circuit and the starting control chip and starting control circuit are mutually connected with the three-channel unit AC output controller; and a first group of AC output circuit, a second group of AC output circuit and a third group of AC output circuit are arranged on the three-channel unit AC output controller;

wherein the first group of AC output circuit is connected with the seventh light-emitting line, the second group of AC output circuit is connected with the eighth light-emitting line, and the third group of AC output circuit is connected with the ninth light-emitting line.

* * * * *